United States Patent [19]

Saiki et al.

[11] Patent Number: 4,632,767

[45] Date of Patent: Dec. 30, 1986

[54] ANTISTATIC AGENTS FOR SYNTHETIC FIBERS

[75] Inventors: Masatsugu Saiki, Okazaki; Yoshio Imai; Makoto Takagi, both of Gamagori, all of Japan

[73] Assignee: Takemoto Yushi Kabushiki Kaisha, Gamagori, Japan

[21] Appl. No.: 801,941

[22] Filed: Nov. 26, 1985

[30] Foreign Application Priority Data

Jun. 14, 1985 [JP] Japan ..... 60-130243

[51] Int. Cl.[4] ..... D06M 11/00

[52] U.S. Cl. ..... 252/8.8; 57/901; 252/8.6

[58] Field of Search ..... 252/8.8, 8.6; 57/901

[56] References Cited

U.S. PATENT DOCUMENTS

| | | | |
|---|---|---|---|
| 2,286,794 | 6/1942 | Dickey et al. | 252/8.8 |
| 4,264,516 | 4/1981 | Hiestand | 252/8.8 |
| 4,291,071 | 9/1981 | Harris et al. | 252/8.8 |
| 4,559,151 | 12/1985 | Pregozen et al. | 252/8.8 |

*Primary Examiner*—Lorenzo B. Hayes
*Assistant Examiner*—Willie J. Thompson
*Attorney, Agent, or Firm*—Flehr, Hohbach, Test, Albritton & Herbert

[57] ABSTRACT

Antistatic agents for synthetic fibers comprising 5–50 weight percent of a specific type of quaternary ammonium alkyl phosphate containing 1 weight percent or less of by-product alkali metal halides and 50–95 weight percent of alkali metal salt of saturated alkyl phosphate have improved antistatic characteristics both in high and low humidity conditions, reduce the amount of deposits that fall off, yellowing by a heat treatment and generation of rust, and allow good coiling forms to be obtained.

4 Claims, No Drawings

ANTISTATIC AGENTS FOR SYNTHETIC FIBERS

This invention relates to antistatic agents for synthetic fibers.

In general, static electricity presents problems to synthetic fibers not only in the manufacturing process of filament yarn and staple fiber, spinning process, weaving process and finishing process but also regarding products made from them. Static electricity impedes operations and lowers the quality of products by dishevelling and wrapping and producing fluff. It thus gives shocks to people, causes the clothes to stick and attracts dust particles. It is therefore necessary to use an antistatic agent with synthetic fibers but such an antistatic agent must be able to exhibit its effectiveness not only under a condition of high humidity but also when humidity is low.

During the production of synthetic fibers, finishing oil which fall off and deposit themselves on the machines during each process present serious problems. During a spinning process, for example, the fibers may be caused to wrap around a draft rubber roller. If they fall off onto a guide or a trumpet, these machine parts must be cleaned more frequently. If they fall off onto a heater during a spinning-drawing process, tar will be generated. If they fall off onto a guide during a warping process, it will generate fluff and cause yarn breakage. As the processing speed is increased, the problems caused by the deposit become even more serious and this necessarily implies that antistatic agents to be applied to synthetic fibers must have the property of not falling off at a significant rate. The present invention relates to antistatic agents for synthetic fibers having this required characteristic.

There are many types of surface active agents (cationic, anionic, non-ionic and amphoteric) serving as antistatic agents for synthetic fibers. Alkyl phosphates exhibit favorable antistatic properties under conditions of high and medium humidity, do not fall off very much, do not turn yellow by a heat treatment and do not rust much, but are not as effective as desired as an antistatic agent in low humidity situations.

Quaternary ammonium salts such as trimethyl lauryl ammonium chloride, triethyl polyoxyethylene (3 mols) stearyl ammonium methosulfate, and tributyloctyl ammonium nitrate have also been used as antistatic agents. These quaternary ammonium salts are advantageous in that they exhibit favorable antistatic properties not only at high humidity but also at low humidity but they fall off, turn yellow by a heat treatment and generate rusts.

These problems associated with quaternary ammonium salts, however, are thought to be caused by the counter anions of quaternary ammonium cations. In fact, if the counter anion is $Cl^-$, rusting becomes a serious problem and if it is $NO_3^-$ or $CH_3SO_4^-$, yellowing becomes serious. Earlier, quaternary ammonium salts with phosphate anion introduced as counter anion came to be considered (Japanese Patent Tokko 45-573 and Tokkai 54-70223). These quaternary ammonium lower alkyl phosphates exhibit favorable antistatic properties both at high humidity and at low humidity and have the advantages of not turning yellow much by a heat treatment and not producing much rust, but have the problem of falling off significantly.

It is therefore an object of the present invention to eliminate the aforementioned problems by providing antistatic agents for synthetic fibers which are capable of exhibiting favorable antistatic properties under both high and low humidity conditions and do not fall off, turn yellow by a heat treatment or rust much.

An antistatic agent for synthetic fibers according to this invention comprises 5–50wt % of quaternary ammonium alkyl phosphates shown by the formula (I) or (II) below and not containing more than 1wt% of by-product alkali metal halides and 50–95wt% of alkali metal salts of saturated alkyl phosphate with 50% or more of alkyl groups with 18 or more carbon atoms:

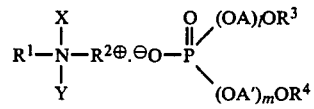

(I)

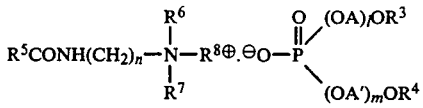

(II)

where $R^1$ and $R^3$ are alkyl group or alkenyl group with 8–18 carbon atoms, $R^2$, $R^6$, $R^7$ and $R^8$ are alkyl group with 1–3 carbon atoms, $R^4$ is hydrogen or alkyl or alkenyl group with 8–18 carbon atoms, $R^5$ is alkyl or alkenyl group with 7–17 carbon atoms, X is alkyl group with 1–3 carbon atoms or a group shown by $-(AO)_qH$, Y is alkyl group with 1–3 carbon atoms or a group shown by $-(A'O)_rH$, AO and A'O being the same respectively as OA and OA' in the formulas (I) and (II), q and r are integers in the range of 2–40 such that $q+r=4$–42, OA and OA' are a single oxyethylene or oxypropylene group or a block or random connected mixture thereof, l and m are each zero or an integer in the range of 1–20 such that $l+m=0$–20, and n is 2 or 3.

In the formulas (I) and (II), if the number of carbon atoms in $R^1$ and $R^3$ is less than 8 or that in $R^5$ is less than 7, the amount of deposit increases. If the content of by-product alkali metal halides exceeds 1wt% with respect to the quaternary ammonium alkyl phosphate, there is increased yellowing by a heat treatment and rusting. For this reason and in particular for preventing rust, particular preferable content of alkali metal halides which is particularly preferable is 0.3wt% or less with respect to quaternary ammonium alkyl phosphate.

Examples of quaternary ammonium alkyl phosphate of the present invention shown by the formula (I) or (II) include combinations of the following quaternary ammonium cations and phosphate anions. The quaternary ammonium cations may be trimethyloctyl ammonium cation, triethylstearyl ammonium cation,

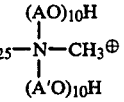

where AO and A'O are the same as in (I), triethyl octanoic amidopropyl ammonium cation, etc. The phosphate anion may be polyoxyethylene (3 mols) lauryl phosphate anion, polyoxyethylene (10 mols) stearyl phosphate anion, octyl phosphate anion, etc.

In the following, methods of producing quaternary ammonium alkyl phosphates of this invention will be explained. Because of their characteristic chemical structures, the quaternary ammonium alkyl phosphates of the present invention cannot be produced advantageously from a practical point of view by any of the conventional methods. There has been known a method, for example, of preventing alkali metal halides from being produced as by-products by direct reaction between tertiary amine and lower alkyl triester of phosphoric acid (Japanese patent Tokko 45-573 and Tokkai 54-70223), but since triesters of phosphoric acid with a long-chain alkyl group have low reactivity with tertiary amines, they are not practical for the production of quaternary ammonium long-chain alkyl phosphates.

According to another conventional method, an alkali metal salt of mono- and/or di-long-chain alkyl phosphate is reacted with mono-long-chain alkyl tri-short-chain alkyl ammonium halide by a salt exchange in water or an alcohol solvent such as methanol, isopropanol, etc. Quaternary ammonium alkyl phosphates are the produced by filtering inorganic by-product compounds such as alkali metal halides. Although this conventional method is popular for the production and refining of so-called complex salts which are combinations of anion and cation active agents, it is not appropriate for keeping the content of inorganic by-products to 1wt% or less because both the quaternary ammonium halide and the alkali metal salt of alkyl phosphate to be used contain long-chain alkyl groups and it is stoichiometrically difficult to carry out the salt exchange reaction for increasing their concentrations to relatively high levels in the range of 10–50wt% in water or alcohol-type solvent which are required for industrial reasons. Accordingly, there will remain unused quaternary ammonium halides and alkali metal salts of alkyl phosphate and this makes it practically impossible to reduce the content of alkali metal halides to 1wt% or less with respect to quaternary ammonium alkyl phosphates.

Quaternary ammonium alkyl phosphates according to this invention can be produced by the method described below. First, tertiary amine shown by the following formula (1) or (2) is quaternalized by alkyl halide (with alkyl group given by $R^2$ or $R^8$ of (I) or (II)). Next, lower alcoholate of alkyl metal is used in the presence or absence of lower alcohol as solvent to exchange the halogen anions of the anion part with lower alcoxy anions, and after the alkali metal halides generated at this time as by-products are separated, mono- or di-alkyl phosphate shown by the following formula (3) is used to exchange the alcoxy anions:

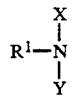

(1)

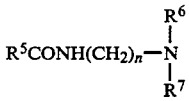

(2)

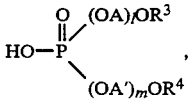

(3)

where $R^1$, $R^3$, $R^4$, $R^5$, $R^6$, $R^7$ X, Y, l, m and n are as defined above.

Examples of alkali metal alcoholate which may be used here include sodium methylate, sodium ethylate and potassium isopropoxide, but sodium methylate is industrially advantageous. Favorable results are obtained in view of the salt exchange reaction and the separation process thereafter, if lower alcohol such as methanol, ethanol and isopropanol is used as solvent. Thus, quarternary ammonium alkyl phosphates of the present invention are mixtures of mono alkyl phosphate and dialkyl phosphate of quarternary ammonium.

Quaternary ammonium alkyl phosphates of the present invention can be used singly as an antistatic component of a finishing oil for synthetic fibers but there are situations in which they prove to be even more effective if used as an appropriate mixture with a conventional antistatic agent. For example, a mixture with an appropriate amount of quaternary ammonium alkyl phosphate added to an antistatic agent of alkyl phosphate type not only provides to synthetic fibers an antistatic property to such a degree that was totally unexpected from a single alkyl phosphate system but also prevents the wrapping and falling off and a good coiling form can be obtained.

Representative examples of alkyl phosphate type antistatic agent of which the effectiveness can be significantly improved by the addition of an appropriate amount of quaternary ammonium phosphate of the present invention include alkali metal salts of saturated alkyl phosphate having as principal component alkyl group with 18 or more carbon atoms. In such a mixed system, the content of the quaternary ammonium alkyl phosphate of the present invention should be 5–50wt%. Although the optimum ratio varies, depending on the kinds of quaternary ammonium alkyl phosphate and alkali metal salt of alkyl phosphate, a particularly preferable range is 5–20wt% of quaternary ammonium phosphate (that is, 95–80wt% of alkali metal salt of alkyl phosphate). The antistatic agents of this invention can be applied singly to synthetic fibers such as polyesters, polyacrylonitriles and polyamides or to their mixtures with natural and chemical fibers. The rate of application to such synthetic fibers (inclusive of mixed fibers) is generally 0.01–2wt% and preferably 0.01–0.5wt%. They may be applied to filaments, a tow or staple fibers by a kiss-roll method, by dipping or by spraying either during or after a spinning process. They may also be applied to fiber products.

In what follows, the present invention and its effects will be explained further in detail by way of examples and comparisons and it should be understood that these examples are not intended to limit the scope of this invention.

TEST NO. 1

Synthesis of quaternary ammonium alkyl phosphate of this invention (Example A-1):

One mol of phosphoric anhydride was added to three mols of octyl alcohol over a period of one hour at 60°–70° C. while stirring. They were allowed to react with each other at 70° C. for three hours and a mixture of mono and dioctyl phosphate was obtained. Separately, 0.5 mol of octyl dimethylamine and 200 ml of methanol were set inside an autoclave and after the interior gas was replaced by nitrogen, 0.5 molar equivalent of methyl chloride was introduced for a reaction at 60°–70° C. for three hours to obtain octyltrimethyl ammonium chloride. To this was gradually added 96 g of 28% sodium methylate-menthanol solution (0.5 molar equivalent as sodium methylate) for salt exchange and the by-product sodium chloride was filtered away to obtain a methanol solution of octyltrimethyl ammonium methoxide. To this methanol solution was added 0.5 mol of the aforementioned mixture of mono and dioctyl phosphate and after methanol was distilled away, it was diluted with water to obtain 50wt% aqueous solution of octyltrimethyl ammonium octyl phosphate (A-1).

Other quaternary ammonium alkyl phosphates (A-2 through A-11 and B-1 through B-16 except B-12; only those starting with the letter A are quaternary ammonium alkyl phosphates of this invention) were synthesized as follows.

SYNTHESIS OF A-2 THROUGH A-11

They were obtained by methods similar to the method for A-1.

SYNTHESIS OF B-1 THROUGH B-8

They were obtained by methods similar to the method for A-1.

B-9 THROUGH B-12

Conventionally available products were used.

SYNTHESIS OF B-13

This was done by heating to dissolve 347.5 g (1 mol) of stearyl trimethyl ammonium chloride and 334.7 g (1 mol) of sodium sesqui stearyl phosphate in 2000ml of a mixed solvent of isopropyl alcohol/water=95/5 (volume ratio). The solution was heated and stirred for one hour at 60° C. and the deposited sodium chloride was filtered away by heating at 45°-50° C. Isopropyl alcohol was distilled from the filtered solution thus obtained while heating under a reduced pressure and trimethyl stearyl ammonium stearyl phosphate with 80% of solid component was obtained.

SYNTHESIS OF B-14

This was done by dissolving with heat 347.5 g (1 mol) of stearyl trimethyl ammonium chloride and 668 g (1 molar equivalent) of 50% aqueous sodium sesqui stearyl phosphate in 2000 ml of isopropyl alcohol and 1000 ml of water and isopropyl alcohol was distilled away under azeotropy while the mixture was heated and stirred. Next, 1000 ml of isopropyl alcohol was added to dilute the solution and sodium chloride which deposited at 35°-40° C. was filtered away. Isopropyl alcohol was distilled away by heating under a reduced pressure from the filtered solution which had been obtained and trimethyl stearyl ammonium stearyl phosphate with 80% of solid component was obtained.

SYNTHESIS OF B-15

This was obtained by a method similar to that for B-13.

SYNTHESIS OF B-16

This was obtained by a method similar to that for B-14.

Each of the examples shown below (except B-12) is described as follows: (1) cation part (2) anion part (mixture of mono and di as in the case of aforementioned A-1, except B-9 through B-12), and (3) content of alkali metal halide (NaCl or KCl) with respect to effective components (weight percent, measured by the Volhard method except for B-9 through B-12). POE, POP and EO respectively stand for polyoxyethylene, polyoxypropylene and oxyethylene.

A-1: (1) trimethyl octyl ammonium, (2) octyl phosphate, (3) 0.18

A-2: (1) trimethyl octyl ammonium, (2) stearyl phosphate, (3) 0.14

A-3: (1) trimethylstearyl ammonium, (2) octyl phosphate, (3) 0.14

A-4: (1) trimethylstearyl ammonium, (2) stearyl phosphate, (3) 0.10

A-5: (1) triethyl octanoic amido propyl ammonium, (2) POE (4 mols) octyl phosphate, (3) 0.20

A-6: (1) triethyl octanoic amido propyl ammonium, (2) POE (15 mols) stearyl phosphate, (3) 0.24

A-7: (1) triethyl stearoic amido propyl ammonium, (2) POE (2 mols)/POP (1 mol) octyl phosphate, (3) 0.23

A-8: (1) triethyl stearoic amido propyl ammonium, (2) POE (5 mols)/POP (1 mol) stearyl phosphate, (3) 0.24

A-9: (1)

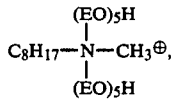

(2) octyl phosphate, (3) 0.63

A-10: (1)

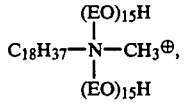

(2) stearyl phosphate, (3) 0.27

A-11: (1) trimethyloctyl ammonium, (2) octyl phosphate, (3) 0.80

B-1: (1) trimethylhexyl ammonium, (2) octyl phosphate, (3) 0.25

B-2: (1) trimethylhexyl ammonium, (2) stearyl phosphate, (3) 0.20

B-3: (1) trimethyloctyl ammonium, (2) butyl phosphate, (3) 0.34

B-4: (1) triethyl butanoic amido propyl ammonium, (2) octyl phosphate, (3) 0.75

B-5: (1) triethylbutanoic amido propyl ammonium, (2) stearyl phosphate, (3) 0.63

B-6: (1) monomethyl dioctylbutanoic amido propyl ammonium, (2) butyl phosphate, (3) 0.01

B-7: (1)

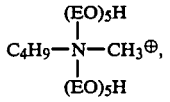

(2) octyl phosphate, (3) 0.83

B-8: (1)

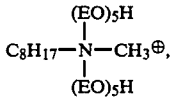

(2) butyl phosphate, (3) 0.72

B-9: (1) trimethyloctyl ammonium, (2) chloride

B-10: (1) triethyloctylamidpropyl ammonium, (2) methosulfate

B-11: (1)

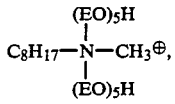

(2) nitrate

B-12: (1) potassium lauryl phosphate

B-13: (1) trimethylstearyl ammonium, (2) stearyl phosphate, (3) 2.10

B-14: (1) trimethylstearyl ammonium, (2) stearyl phosphate, (3) 1.43

B-15: (1) trimethyloctyl ammonium, (2) octyl phosphate, (3) 2.47

B-16: (1) trimethyloctyl ammonium, (2) octyl phosphate, (3) 1.71

The following measurements and evaluations were made regarding A-1 through A-11 and B-1 through B-16.

MEASUREMENT OF ELECTRICAL RESISTANCE AND EVALUATION OF YELLOWING

Staple fiber samples were prepared by applying 0.1% (effective weight percent) of each example by a spray method to polyester staple fibers (1.4-denier, 38 mm) and dried for one hour at 60° C. These samples were left for 24 hours under the conditions of 25° C. and 40%RH or 25° C. and 65%RH, and their electrical resistance was measured. They were also subjected to a heat treatment at 150° C. for two hours and the degrees of their yellowing were observed and evaluated visually.

MEASUREMENT OF ELECTROSTATIC CHARGE GENERATED BY FRICTION

Pieces of refined woven acrylic cloth were immersed in 0.2% (effective weight percent) water solution of each example and then dried for one hour at 60° C. They were left for 24 hours under the conditions of 25° C. and 40%RH and their static charges were measured by a rotary static tester.

EVALUATION OF DEPOSIT THAT FALL OFF

Staple fiber samples were prepared by applying 0.12% (effective weight percent) of each example by a spray method to polyester staple fibers (1.4-denier, 38 mm) and were left for 24 hours under the conditions of 30° C. and 70%RH. These samples were used and 10 kg of slivers manufactured by a carding engine was passed through a drawing frame. The deposits that fall off and become adhered to the trumpet to which the sliver is taken up were visually observed. Grades A through E were assigned in the increasing order of the amount of deposits, grade A being given if this amount is very small.

EVALUATION OF RUSTING

After washed knitting needles were immersed in 2% (effective weight percent) water solutions of individual examples, they were left for 24 hours under the conditions of 20° C. and 100%RH and the appearance of rust on each needle was visually observed and evaluated.

The results of the above are shown in Tables 1 and 2.

TABLE 1

| A-No | Resistance (Ω) 25° C., 40% RH | Resistance (Ω) 25° C., 65% RH | Static Charge (V) | Deposit | Yellowing | Rust |
|---|---|---|---|---|---|---|
| 1 | $1.2 \times 10^7$ | $8.8 \times 10^5$ | 100 | A | None | None |
| 2 | 4.3 | 16 | 200 | A | None | None |
| 3 | 5.7 | 33 | 170 | A | None | None |
| 4 | 8.5 | 53 | 450 | A | None | None |
| 5 | 3.2 | 13 | 180 | A | None | None |
| 6 | 6.5 | 45 | 250 | A | None | None |
| 7 | 6.3 | 43 | 210 | A | None | None |
| 8 | 8.8 | 74 | 470 | A | None | None |
| 9 | 1.3 | 9.0 | 100 | A | None | Slight |
| 10 | 3.3 | 21 | 120 | A | None | None |
| 11 | 1.5 | 8.5 | 100 | A | None | Slight |

TABLE 2

| B-No | Resistance (Ω) 25° C., 40% RH | Resistance (Ω) 25° C., 65% RH | Static Charge (V) | Deposit | Yellowing | Rust |
|---|---|---|---|---|---|---|
| 1 | $1.0 \times 10^7$ | $11 \times 10^5$ | 110 | E | Slight | None |
| 2 | 4.2 | 10 | 170 | D | None | None |
| 3 | 3.2 | 9.5 | 100 | E | Slight | None |
| 4 | 3.5 | 21 | 210 | E | None | None |
| 5 | 4.7 | 3.5 | 350 | D | None | None |
| 6 | 15 | 170 | 700 | D | None | None |
| 7 | 1.3 | 12 | 100 | E | None | None |
| 8 | 1.1 | 8.8 | 100 | E | None | None |
| 9 | 3.5 | 22 | 210 | D | Present | Great |
| 10 | 3.1 | 36 | 480 | E | Present | Great |
| 11 | 7.7 | 44 | 400 | E | Present | Great |
| 12 | 600 | 890 | 1400 | A | None | None |
| 13 | 8.3 | 61 | 430 | B | Present | Great |
| 14 | 8.4 | 59 | 400 | A | Slight | Great |
| 15 | 1.1 | 17 | 90 | E | Slight | Great |
| 16 | 4.0 | 15 | 360 | D | Slight | Great |

TEST NO. 2

Emulsions were prepared from individual finishing oil (sample of present invention 1–12 and comparison samples 1–9) having compositions (weight percent) shown in Tables 3 and 4 and fiber samples were produced by applying 0.15wt% of each by the spray method individually to polyester staple fibers (1.4-denier, 38 mm) and leaving for 24 hours under the temperature and humidity conditions shown in Tables 5 and 6. The following measurements were made and evaluated. The results of the test are shown in Tables 5 and 6.

MEASUREMENT OF ELECTRIC RESISTANCE

Measurements were taken as in Test No. 1.

MEASUREMENT OF ROLLER WRAPPING

Roving yarns produced from the fiber samples by using a roving frame were spun out of a spinning frame and the number of the fibers wrapped around the rubber roller (manufactured by Yamanouchi Rubber Company, hardness 82 degrees) was counted.

EVALUATION OF DEPOSITS

Testing and evaluation were done as in Test No. 1.

EVALUATION OF COILING FORM

Samples were processed to drawing frame and the forms of the produced silver coils were evaluated and graded similarly into five levels from A (very good) to E (not good).

TABLE 3

| | (Samples of present invention) | | | | | | |
|---|---|---|---|---|---|---|---|
| No. | A-1 | A-4 | A-5 | A-10 | P-1 | P-2 | P-3 |
| 1 | 5 | | | | 95 | | |
| 2 | 10 | | | | 90 | | |
| 3 | | 10 | | | 90 | | |
| 4 | | | 10 | | 90 | | |
| 5 | 15 | | | | | 85 | |
| 6 | | | | 15 | | | 85 |
| 7 | 20 | | | | 80 | | |
| 8 | | 20 | | | | 80 | |
| 9 | 30 | | | | 70 | | |
| 10 | | 30 | | | | 70 | |
| 11 | | | 40 | | | | 60 |
| 12 | 45 | | | | 55 | | |

TABLE 4

| | (Comparison samples) | | | | | | | | | |
|---|---|---|---|---|---|---|---|---|---|---|
| No. | A-1 | A-4 | B-15 | B-16 | B-13 | B-3 | P-1 | P-2 | P-4 | P-5 |
| 1 | | | 5 | | | | 95 | | | |
| 2 | | | 10 | | | 90 | | | | |
| 3 | | 15 | | | | | 85 | | | |
| 4 | | 30 | | | | 70 | | | | |
| 5 | | | | 30 | | | 70 | | | |
| 6 | 10 | | | | | | | | 90 | |
| 7 | | 20 | | | | | | | | 80 |
| 8 | 30 | | | | | | | | | 70 |
| 9 | | | | | | 10 | 90 | | | |

In Tables 3 and 4, A-1 through A-10 and B-1 through B-16 are the same as previously defined. P-1, P-2 and P-3 are all potassium salts of saturated alkyl phosphate with octadecyl/hexadecyl=90/10, 85/15 and 65/35, respectively. P-4 and P-5 are respectively potassium hexadecyl phosphate and potassium dodecyl phosphate.

TABLE 5

| | (Samples of present invention) | | | | |
|---|---|---|---|---|---|
| | Resistance (Ω) | | Wrapping (times) | Deposit | Coiling Form |
| No. | 25° C., 40% RH | 25° C., 65% RH | 30° C., 70% RH | 30 ° C., 70% RH | 30° C., 70% RH |
| 1 | $9.2 \times 10^7$ | $12.5 \times 10^5$ | 0 | A | A |
| 2 | 6.3 | 10.0 | 0 | B | B |
| 3 | 7.4 | 11.2 | 0 | A | A |
| 4 | 4.5 | 8.2 | 1 | B | B |
| 5 | 6.0 | 9.5 | 0 | B | B |
| 6 | 3.0 | 7.0 | 7 | B | C |
| 7 | 2.8 | 6.5 | 2 | B | B |
| 8 | 7.2 | 10.5 | 0 | A | A |
| 9 | 2.5 | 5.4 | 7 | B | B |
| 10 | 5.3 | 9.0 | 6 | B | B |
| 11 | 1.4 | 3.2 | 10 | B | C |
| 12 | 1.8 | 3.6 | 8 | B | C |

TABLE 6

| | (Comparison samples) | | | | |
|---|---|---|---|---|---|
| | Resistance (Ω) | | | | |
| No. | 25° C., 40% RH | 25° C., 65% RH | Wrapping (times) | Deposit | Coiling Form |
| 1 | $9.0 \times 10^7$ | $11.8 \times 10^5$ | 7 | C | E |
| 2 | 6.0 | 9.6 | 10 | C | E |
| 3 | 6.2 | 9.0 | 12 | D | E |
| 4 | 2.0 | 5.2 | 15 | D | E |
| 5 | 4.9 | 8.8 | 20 | E | E |
| 6 | 8.3 | 10.3 | 18 | B | E |
| 7 | 2.1 | 5.1 | 15 | C | E |
| 8 | 1.0 | 2.8 | 17 | C | E |
| 9 | 6.2 | 8.9 | 7 | D | D |

Comparisons between Tables 1 and 2 and between Tables 5 and 6 clearly demonstrate that the finishing oil of the present invention described hereinabove exhibit superior antistatic characteristics both in high humidity and low humidity conditions, reduce the amount of deposits that fall off, yellowing by a heat treatment and generation of rust, and allow good coiling forms to be obtained.

What is claimed is:

1. An antistatic agent for synthetic fibers comprising 5–50 weight percent of quaternary ammonium alkyl phosphate which is shown by the formula (I) or (II) below and contain 1 weight percent or less of by-product alkali metal halides and 50–95 weight percent of alkali metal salt of saturated alkyl phosphate with 50% or more of alkyl groups with 18 or more carbon atoms;

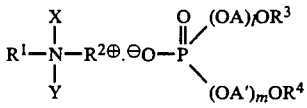

(I)

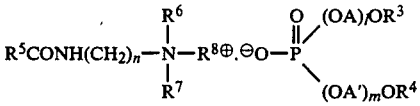

(II)

where $R^1$ and $R^3$ are alkyl group or alkenyl group with 8–18 carbon atoms, $R^2$, $R^6$, $R^7$ and $R^8$ are each alkyl group with 1–3 carbon atoms, $R^4$ is hydrogen or alkyl group or alkenyl group with 8–18 carbon atoms, $R^5$ is alkyl group or alkenyl group with 7–17 carbon atoms, X is alkyl group with 1–3 carbon atoms or a group shown by $-(AO)_qH$, Y is alkyl group with 1–3 carbon atoms or a group shown by $-(A'O)_rH$, AO and A'O are respectively the same as OA and OA' in the formulas (I) and (II), q and r are integers in the range of 2–40 such that q+r=4–42, OA and OA' are single oxyethylene or oxypropylene group or block or random connected mixture thereof, l and m are 0 or integers in the range of 1–20 such that l+m=0–20, and n is 2 or 3.

2. The antistatic agent of claim 1 comprising 5–20 weight percent of said quaternary ammonium alkyl phosphate and 80–95 weight percent of said alkali metal salt of saturated alkyl phosphate.

3. The antistatic agent of claim 1 wherein said quaternary ammonium alkyl phosphate is obtained by the steps of quaternalizing tertiary amine shown by the formula (1) or (2) by using alkyl halide with 1–3 carbon atoms, subsequently using alkali metal alcoholate to exchange halogen anions in anion section for alcoxy anions, separating alkali metal halide generated as a by-product, and subsequently exchanging said alcoxy anions by using mono- or di-alkyl phosphate shown by the formula (3):

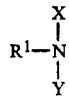

(1)

-continued

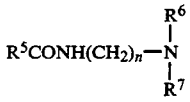

(2)

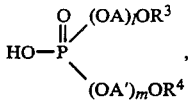

(3)

where $R^1$, $R^3$, $R^4$, $R^5$, $R^6$, $R^7$, X, Y, l, m and n are the same as in the formulas (I) and (II).

4. The antistatic agent of claim 2 wherein said quaternary ammonium phosphate is obtained by the steps of quaternalizing tertiary amine shown by the formula (1) or (2) by using alkyl halide with 1–3 carbon atoms, subsequently using alkali metal alcoholate to exchange halogen anions in anion section for alcoxy anions, separating alkali metal halide generated as a by-product, and subsequently exchanging said alcoxy anions by using mono- or di-alkyl phosphate shown by the formula (3):

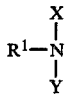

(1)

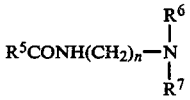

(2)

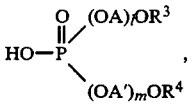

(3)

where $R^1$, $R^3$, $R^4$, $R^5$, $R^6$, $R^7$, X, Y, l, m and n are the same as in the formulas (I) and (II).

* * * * *